United States Patent [19]

Yin

[11] Patent Number: 5,004,877

[45] Date of Patent: Apr. 2, 1991

[54] VACUUM INTERRUPTER

[75] Inventor: Simon Yin, Fremont, Calif.

[73] Assignee: Square D Company, Palatine, Ill.

[21] Appl. No.: 252,679

[22] Filed: Oct. 3, 1988

[51] Int. Cl.[5] ..... H01H 33/66

[52] U.S. Cl. ..... 200/144 B

[58] Field of Search ..... 200/144 B

[56] References Cited

U.S. PATENT DOCUMENTS 4,272,661 6/1981 Dethlefsen ..... 200/144 B

FOREIGN PATENT DOCUMENTS 3529386 2/1987 Fed. Rep. of Germany ... 200/144 B

*Primary Examiner*—Robert S. Macon

*Attorney, Agent, or Firm*—Flehr, Hohbach, Test, Albritton & Herbert

[57] ABSTRACT

Vacuum interrupters having an improved axially movable terminal assembly are provided for use in vacuum circuit breakers or similar protective devices. The improved movable terminal assembly includes an axially movable but non-rotatable internal terminal portion in contact with an axially movable and rotatable external terminal portion adapted for connection in a vacuum circuit breaker or the like. This arrangement allows the external terminal portion to rotate and twist during installation or adjustment of the vacuum interrupter in a circuit breaker device and prevents transmission of torsional stress to the internal terminal portion.

28 Claims, 1 Drawing Sheet

VACUUM INTERRUPTER

TECHNICAL FIELD

The present invention relates generally to vacuum interrupters for use in vacuum circuit breakers and the like, and relates, more specifically, to an axially movable current carrying terminal assembly for use in vacuum interrupters which provides improved mechanical stability, and consequently provides enhanced internal vacuum integrity.

BACKGROUND ART

Interruption in a vacuum circuit breaker is achieved by vacuum interrupters which require only a short contact gap for circuit interruption. Vacuum interrupters typically comprise an insulating cylindrical envelope composed, for example, of glass or alumina, with endcaps mounted at each end to form a closed cylinder. Stationary and movable current conducting terminals are mounted through the endcaps at opposite ends of the cylindrical envelope. The movable terminal is moved axially to make and break contact with the stationary terminal contact, thereby making and breaking the electrical circuit. To permit axial movement of the movable terminal, it is necessary to provide a cylindrical bellows which is attached to the endcap at one end and to an internal portion of the movable terminal at the other end.

Vacuum interrupters of this type are required to maintain an internal vacuum on the order of about $10^{-7}$ Torr to interrupt the current flowing in the electrical circuit. Loss of vacuum permits air or other molecules to enter the evacuated volume, which reduces the internal vacuum and thereby reduces the interrupting capacity and dielectric strength of the internal vacuum. It is essential, therefore, that the interior volume of the interrupter remains hermetically sealed from the external atmosphere to maintain the internal vacuum. The quality of the vacuum interrupter components and materials must be consistently high to prevent introduction of contaminants into the internal vacuum, and to prevent the external walls of the interrupter from developing weak or porous areas which would threaten the integrity of the internal vacuum.

Suitable component materials have been developed and, in general, the interrupter components including the insulating cylindrical envelope, the current conducting terminals, and the endcaps are not prone to develop weak or porous areas which may threaten the integrity of the internal vacuum. One source of fatigue and, consequently, vacuum leakage is the brazed joints which hermetically seal the endcaps to the insulating cylindrical envelope. Another source of vacuum leakage is mechanical damage to the interrupter components which may occur during installation or adjustment of the vacuum interrupter in a vacuum circuit breaker.

FIG. 1 illustrates conventional prior art vacuum interrupter 10 comprising cylindrical insulating envelope 12 composed of alumina or the like, endcaps 14 and 16 mounted at opposite ends of insulating envelope 12, with stationary terminal 18 and movable terminal 20 mounted in opposite endcaps. Stationary terminal 18 is rigidly mounted through endcap 14, while movable terminal 20 is mounted through endcap 16 and guide 22 for axial movement along its central longitudinal axis. Cylindrical bellows 24 is hermetically sealed at one end to endcap 16 at brazed joint 26, and at the opposite end to an internal surface of the movable terminal at brazed joint 28. Bellows 24 permits axial movement of the movable terminal along its central longitudinal axis, and brazed joints 26 and 28 which provide hermetic seals maintain the internal vacuum during movement of the movable terminal.

The area most prone to mechanical damage which results in vacuum leakage has typically been the hermetic seals between the bellows and the endcap at joint 26 and between the bellows and the movable terminal at joint 28. The cylindrical bellows comprises a relatively thin, flexible material which is prone to fatigue and cracking under adverse conditions. The bellows and the sealing joints supporting the bellows in the vacuum interrupter may be damaged by axial overstress caused by excessive stroke lengths of the movable terminal, or by rotation or twisting of the movable terminal about its central longitudinal axis. Twisting of the movable terminal about its central longitudinal axis typically occurs during installation of a vacuum interrupter in a vacuum circuit breaker or similar protective device, as the interrupter is being positioned, adjusted, and finally fastened in place. Damage to the bellows due to such twisting motion generally occurs along joints 26 and 28, where the peripheral edges of the bellows are sealed to the endcap or the movable terminal.

Several techniques have been utilized to prevent damage to the bellows or its sealing joints due to rotation or twisting of the movable terminal assemblies of vacuum interrupters. Typically, the contact column of the movable terminal is provided with a non-round cross-sectional configuration for at least a portion of its length, and the external guide member is provided with a corresponding non-round bore to prevent rotation of the movable contact column in the guide member. This technique limits rotation of the movable terminal and the bellows, but it does not prevent end bearing friction which may occur when the entire interrupter is twisted and the non-round contact column of the movable terminal is forced against the corresponding walls of the guide member. This type of motion is particularly likely to occur during installation or adjustment of a vacuum interrupter in the vacuum circuit breaker, or removal of a vacuum interrupter from the vacuum circuit breaker.

Accordingly, it is an objective of the present invention to provide a vacuum interrupter having an internal volume which is hermetically sealed from the external atmosphere in a manner which substantially reduces contamination and leakage of the internal vacuum.

It is another objective of the present invention to provide an improved vacuum interrupter which is durable and reliable over the course of longterm operations.

It is still another objective of the present invention to provide an improved vacuum interrupter which reduces stress and fatigue at the brazed joints hermetically sealing the bellows at the movable terminal.

It is yet another objective of the present invention to provide a vacuum interrupter which permits rotation or twisting of an external portion of the movable terminal without transferring the stress and strain due to the rotation or twisting motion to the bellows.

It is still another objective of the present invention to provide an improved movable terminal assembly for use in a vacuum interrupter.

DISCLOSURE OF THE INVENTION

The vacuum interrupter of the present invention includes an improved movable terminal assembly comprising a rotatable external terminal portion fastened to an internal portion which is axially movable but non-rotatable. The external portion of the movable terminal assembly is adapted for connection to a vacuum circuit breaker or similar protective device. A cylindrical bellows is hermetically sealed at one peripheral edge to the non-rotatable internal terminal portion and at the opposite peripheral edge to the endcaps. A current transfer means is provided in contact with both the internal and external portion of the movable terminal assembly to provide current flow through the movable terminal assembly. The external portion of the movable terminal may thus be rotated or twisted during installation or adjustment of the vacuum interrupter in a vacuum circuit breaker apparatus without transferring the stress from rotational or twisting motion to the internal portion of the movable terminal or the cylindrical bellows.

BRIEF DESCRIPTION OF THE DRAWINGS

The above-mentioned and additional features of the present invention and the manner of obtaining them will become apparent, and the invention will be best understood by reference to the following more detailed description read in conjunction with accompanying drawings, in which.

BEST MODE OF CARRYING OUT THE INVENTION

Figure 1:
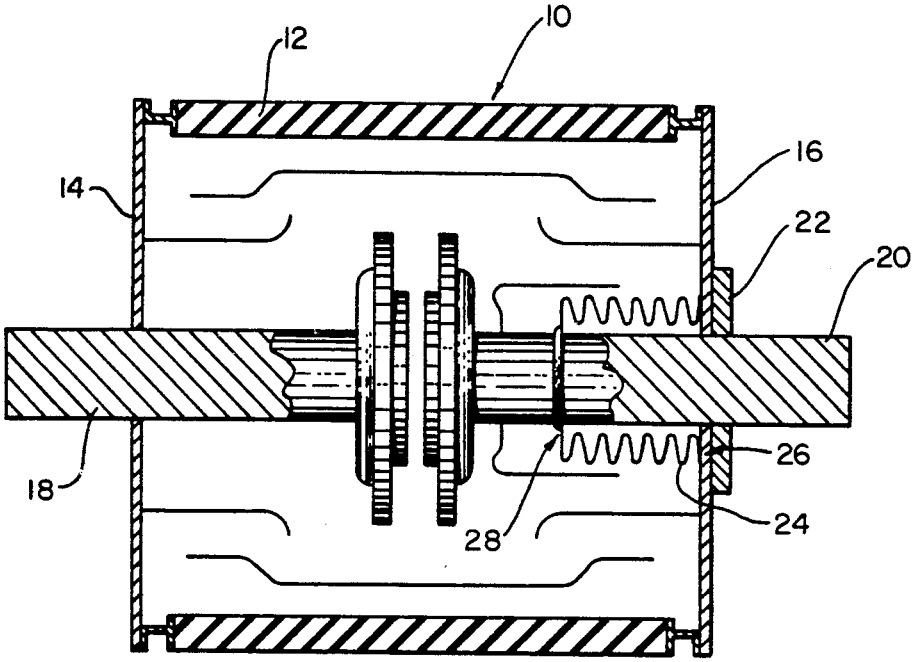
FIG. 1 (PRIOR ART)
FIG. 1 shows a schematic, partially cross-sectional view of a conventional prior art vacuum interrupter.
Figure 2:
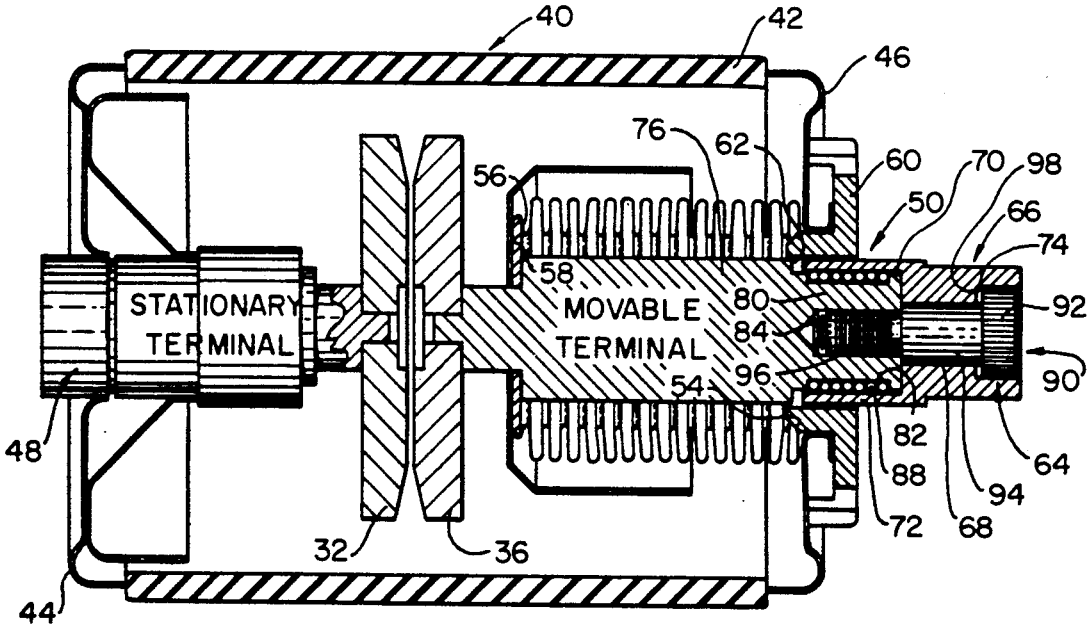
FIG. 2 shows a schematic, partially cross-sectional view of a vacuum interrupter of the present invention, including the improved movable terminal assembly.

FIG. 2 illustrates vacuum interrupter 40 incorporating an improved movable terminal assembly according to the present invention. Cylindrical insulating envelope 42 comprises alumina, glass, or the like, and insulating envelope 42 is sealed at each circumferential end to endcaps 44 and 46. Stationary terminal 48 has stationary electrical contact 32 at its internal terminal end and is rigidly mounted in endcap 44, while movable terminal 50 has axially movable electrical contact 36 at its internal terminal end and is mounted in endcap 46. Cylindrical bellows 52 permits axial movement of movable terminal 50 along its central longitudinal axis to make and break contact between movable electrical contact 36 and stationary electrical contact 32. Cylindrical bellows 52 is hermetically sealed along its peripheral edges to endcap 46 at seal 54 and to movable terminal flange 58 at seal 56. Seals 54 and 56 are hermetic seals, and serve to maintain the internal vacuum during operation of the vacuum interrupter.

Movable terminal 50 is mounted through a receiving bore in guide member 60, and guide member 60 is rigidly mounted in a central portion of endcap 46. Movable terminal 50 comprises external terminal portion 66 fastened to internal terminal portion 76 by means of fastening member 90. Movable terminal contact 36 is mounted on the internal end of internal terminal portion 76. As shown in FIG. 2, internal terminal portion 76 includes larger diameter portion 78 which extends for substantially the length of cylindrical bellows 52 and smaller diameter portion 80 having annular groove 82 therein. Circumferential rim 62 is located at the interface of larger diameter portion 78 and smaller diameter portion 80. Central bore 84 is provided in the external end of smaller diameter portion 80 and is aligned with the central longitudinal axis of internal terminal portion 76.

The external portion of the movable terminal assembly is adapted for connection to a vacuum circuit breaker or similar protective device. External terminal portion 66 comprises a generally cylindrical member having central bore 68 and enlarged bore 70 defined by annular flange 72. The outer circumference of annular flange 72 is sized to correspond approximately to the inner diameter of guide member 60, so that annular flange 72 is axially and rotatably movable in guide member 60. The inner circumference of annular flange 72 is sized to correspond approximately to the outer diameter of smaller diameter portion 80 of internal terminal portion 76, so that smaller diameter portion 80 of internal terminal portion 76 is retained snugly by annular rim 72 but rotation of the external terminal portion is permitted. The depth of enlarged bore 70 is preferably slightly less than the length of smaller diameter portion 80 of internal terminal portion 76. Enlarged receiving bore 64 is preferably provided on the external end of external terminal portion 66 for receiving an enlarged fastener head or suitable means to connect the movable terminal to an actuating mechanism which opens and closes the contacts 32 and 36.

Internal terminal portion 76 and external terminal portion 66 are engaged by means of fastening member 90. According to the preferred embodiment illustrated in FIG. 2, fastening member 90 includes enlarged head 92, shank portion 94, and fastening end 96. Enlarged head 92 is sized to fit in enlarged receiving bore 64. Shank portion 94 of the fastening member is received through central bore 68 in external terminal portion 66. Shank portion 94 is preferably slightly longer than central bore, 68, and the diameter of shank portion 94 is preferably slightly less than that of central bore 68. The internal peripheral edge of shank portion 94 abuts the external surface of smaller diameter portion 80 and acts as a stop during the fastening operation. As shown in FIG. 2, this geometry provides annular cavity 74 between enlarged head 92 of the fastening member and flange 98 located at the interface of enlarged receiving bore 64 and central bore 68. This arrangement allows the external portion of the movable contact terminal to rotate and swivel with respect to the internal portion of the terminal, and prevents transmission of torsional stress to the internal terminal portion, the bellows and its sealing joints.

Terminal fastening end 96 of fastening member 90 fastens in fastener receiving bore 84 of internal terminal portion 76. Terminal fastening end 96 is preferably threaded and fastener receiving bore 84 is preferably provided with corresponding internal threads for secure fastening. Once fastening member 90 has been fastened, it is preferably prevented from further rotation by application of an antivibration material such as nylon, locktite, tape, or the like in the threaded areas.

Due to the assembly of the movable terminal in separate internal and external portions, means must be provided for conducting current between the internal and external portions of the terminal assembly to provide the required current flow. Current transfer element 88 is mounted in annular groove 82 to establish current flow directly from smaller diameter portion 80 of the internal portion to annular flange 72 of the external portion. Current transfer element 88 may comprise a variety of current transfer means which are known to the art, such as MULTILAM louvered strips, coiled non-ferrous springs with barrel side compression, contact shoes, roller contacts, and the like. The size and type of current transfer element 88 is selected to provide transfer of continuous and short circuit currents between the internal and external portions of the movable terminal assembly.

The external terminal portion of the movable terminal assembly may be rotated or twisted with respect to the internal terminal portion during installation or adjustment of the vacuum interrupter in a vacuum circuit breaker without compromising the integrity of the internal vacuum. The bellows and the internal portion of the movable terminal are in an axially movable but non-rotatable position which prevents transmission of stress and strain to the bellows or its hermetic seals due to external forces.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A vacuum interrupter, comprising:

a cylindrical envelope;

an endcap hermetically sealed at each circumferential edge of said cylindrical envelope;

a stationary terminal rigidly mounted in a central portion of one endcap; and a movable terminal mounted for axial movement along its central longitudinal axis in a central position of an opposite endcap, said movable terminal comprising a rotatable external portion in electrical contact with a non-rotatable internal portion, said rotatable external portion being fixed relative to said non-rotatable internal portion along said central longitudinal axis when said external portion rotates relative to said internal portion.

2. A vacuum interrupter according to claim 1, additionally comprising a cylindrical bellows hermetically sealed at one circumferential edge to said non-rotatable internal portion of said movable terminal and hermetically sealed at an opposite circumferential edge to said opposite endcap.

3. A vacuum interrupter according to claim 2, wherein said rotatable external portion of said movable terminal is adapted for connection to a vacuum circuit breaker terminal.

4. A vacuum interrupter according to claim 3, additionally comprising current transfer means in electrical contact with said non-rotatable internal portion and said rotatable external portion of said movable terminal, said current transfer means adapted to establish current flow directly between said internal and external terminal portions.

5. A vacuum interrupter according to claim 4, wherein said internal terminal portion comprises a larger diameter portion which extends for substantially the length of said cylindrical bellows, a smaller diameter portion having an annular groove therein, and an internal circumferential rim located at an interface of said larger diameter portion and said smaller diameter portion.

6. A vacuum interrupter according to claim 5, wherein said external terminal portion comprises a generally cylindrical member having an enlarged bore defined by an internal annular flange, and said smaller diameter portion of said internal terminal portion is retained in said enlarged bore of said external portion permitting rotation of said external terminal portion.

7. A vacuum interrupter according to claim 6, wherein said current transfer means is mounted in said annular groove of said smaller diameter portion of said internal terminal portion.

8. A vacuum interrupter according to claim 7, wherein said external and internal terminal portions are fastened to one another by a threaded fastening means.

9. A vacuum interrupter according to claim 8, wherein said smaller diameter portion of said internal terminal portion has a central bore in its external surface, said external terminal portion additionally has a central receiving bore therein, and said threaded fastening means comprises a shank portion received through said central receiving bore and a fastening end threadedly engaged in said central bore of said smaller diameter portion.

10. A movable terminal assembly for use in a vacuum interrupter, comprising:

an endcap having a central recess therein for receiving a movable terminal;

a movable terminal adopted for axial movement along its central longitudinal axis, said movable terminal including a non-rotatable internal portion having a movable terminal contact mounted at a first end thereof; and a rotatable external portion adapted for connection to a vacuum circuit breaker terminal mounted on a second end of said non-rotatable internal portion opposite said first end, said rotatable external portion being fixed relative to said non-rotatable internal portion along said central longitudinal axis when said external portion rotates relative to said internal portion; and a cylindrical bellows hermetically sealed at one circumferential edge to said non-rotatable internal portion of said movable terminal and hermetically sealed at an opposite circumferential edge to said endcap.

11. A movable terminal assembly according to claim 10, additionally comprising current transfer means in electrical contact with said non-rotatable internal portion and said rotatable external portion of said movable terminal, said current transfer means adapted to establish current flow directly between said internal and external terminal portions.

12. A movable terminal assembly according to claim 11, wherein said internal terminal portion comprises a larger diameter portion which extends for substantially the length of said cylindrical bellows, a smaller diameter portion having an annular groove therein, and an internal circumferential rim located at an interface of said larger diameter portion and said smaller diameter portion.

13. A movable terminal assembly according to claim 12, wherein said external terminal portion comprises a generally cylindrical member having an enlarged bore defined by an internal annular flange, and said smaller diameter portion of said internal terminal portion is retained in said enlarged bore of said external portion permitting rotation of said external terminal portion.

14. A movable terminal assembly according to claim 13, wherein said current transfer means is mounted in said annular groove of said smaller diameter portion of said internal terminal portion.

15. A movable terminal assembly according to claim 14, wherein said external and internal terminal portions are fastened to one another by a threaded fastening means.

16. A movable terminal assembly according to claim 15, wherein said smaller diameter portion of said internal terminal portion has a central bore in its external surface, said external terminal portion additionally has a central receiving bore therein, and said threaded fastening means comprises a shank portion received through said central receiving bore and a fastening end threadedly engaged in said central bore of said smaller diameter portion.

17. In a vacuum interrupter of the type comprising
a cylindrical insulating envelope,
first and second endcaps hermetically sealed at each circumferential edge of said cylindrical envelope,
a stationary terminal rigidly mounted in a central portion of the first endcap, and
a movable terminal mounted for axial movement along its central longitudinal axis in a central portion of the second endcap, and a cylindrical bellows hermetically sealed at one circumferential edge to an internal portion of the movable terminal and hermetically sealed at an opposite circumferential edge to the second endcap, the improvement comprising:
providing said movable terminal with a rotatable external portion adapted for connection to a vacuum circuit breaker and a non-rotatable internal portion, said rotatable external portion being fixed relative to said non-rotatable internal portion along said central longitudinal axis when said external portion rotates relative to said internal portion.

18. In a vacuum interrupter according to claim 17, the improvement additionally comprising:
providing current transfer means in electrical contact with said rotatable external portion and said non-rotatable internal portion, said current transfer means adapted to establish current flow directly between said internal and external terminal portions.

19. A vacuum interrupter, comprising:
(a) a cylindrical envelope;
(b) an endcap hermetically sealed at each circumferential edge of said cylindrical envelope;
(c) a stationary terminal rigidly mounted in a central portion of one endcap; and
(d) a movable terminal mounted for axial movement along its central longitudinal axis in a central position of an opposite endcap, said movable terminal including a rotatable external portion in electrical contact with a non-rotatable internal portion, said internal portion including
(i) a larger diameter portion which extends for substantially the length of a cylindrical bellow hermetically sealed at one circumferential edge to said non-rotatable internal portion of said movable terminal and hermetically sealed at an opposite circumferential edge to said opposite endcap;
(ii) a smaller diameter portion having an annular groove therein; and
(iii) an internal circumferential rim located at an interface of said larger diameter portion and said smaller diameter portion; and
(e) current transfer means in electrical contact with said non-rotatable internal portion and said rotatable external portion of said movable terminal, said current transfer means adapted to establish current flow directly between said internal and external terminal problems.

20. A vacuum interrupter according to claim 19, wherein said external terminal portion comprises a generally cylindrical member having an enlarged bore defined by an internal annular flange, and said smaller diameter portion of said internal terminal portion is retained in said enlarged bore of said external portion permitting rotation of said external terminal portion.

21. A vacuum interrupter according to claim 20, wherein said current transfer means is mounted in said annular groove of said smaller diameter portion of said internal terminal portion.

22. A vacuum interrupter according to claim 21, wherein said external and internal terminal portions are fastened to one another by a threaded fastening means.

23. A vacuum interrupter according to claim 22, wherein said smaller diameter portion of said internal terminal portion has a central bore in its external surface, said external terminal portion additionally has a central receiving bore therein, and said threaded fastening means comprises a shank portion received through said central receiving bore and a fastening end threadedly engaged in said central bore of said smaller diameter portion.

24. A movable terminal assembly for use in a vacuum interrupter, comprising:
(a) an endcap having a central recess therein for receiving a movable terminal;
(b) a movable terminal adopted for axial movement along its central longitudinal axis, said movable terminal including
(i) a non-rotatable internal portion having a movable terminal contact mounted at a first end thereof, said internal portion including
(1) a larger diameter portion which extends for substantially the length of a cylindrical bellow hermetically sealed at one circumferential edge to said nonrotatable internal portion of said movable terminal and hermetically sealed at an opposite circumferential edge to said opposite endcap;
(2) a smaller diameter portion having an annular groove therein; and
(3) an internal circumferential rim located at an interface of said larger diameter portion and said smaller diameter portion; and
(ii) a rotatable external portion adapted for connection to a vacuum circuit breaker terminal mounted on a second end of said non-rotatable internal portion opposite said first end; and
(c) current transfer means in electrical contact with said non-rotatable internal portion and said rotatable external portion of said movable terminal, said current transfer means adapted to establish current flow directly between said internal and external terminal problems.

25. A movable terminal assembly according to claim 24, wherein said external terminal portion comprises a generally cylindrical member having an enlarged bore defined by an internal annular flange, and said smaller diameter portion of said internal terminal portion is retained in said enlarged bore of said external portion permitting rotation of said external terminal portion.

26. A movable terminal assembly according to claim 25, wherein said current transfer means is mounted in said annular groove of said smaller diameter portion of said internal terminal portion.

27. A movable terminal assembly according to claim 26, wherein said external and internal terminal portions are fastened to one another by a threaded fastening means.

28. A movable terminal assembly according to claim 27, wherein said smaller diameter portion of said internal terminal portion has a central bore in its external surface, said external terminal portion additionally has a central receiving bore therein, and said threaded fastening means comprises a shank portion received through said central receiving bore and a fastening end threadedly engaged in said central bore of said smaller diameter portion.

* * * * *